US006616020B1

(12) United States Patent
Spielberger

(10) Patent No.: US 6,616,020 B1
(45) Date of Patent: Sep. 9, 2003

(54) HOLSTER FOR HANDGUNS

(76) Inventor: Peter Spielberger, Auhirschenweg 36, A-1220 Wien, Osterreich, Vienna (AT)

( * ) Notice: Subject to any disclaimer, the term of this patent is extended or adjusted under 35 U.S.C. 154(b) by 0 days.

(21) Appl. No.: 09/382,113

(22) Filed: Aug. 24, 1999

(51) Int. Cl.[7] ..... F41C 33/02
(52) U.S. Cl. ..... 224/244; 224/183; 224/911
(58) Field of Search ..... 224/183, 243, 224/244, 911

(56) References Cited

U.S. PATENT DOCUMENTS 3,008,617 A * 11/1961 Villwock ..... 224/183 X
5,275,317 A * 1/1994 Rogers et al. ..... 224/244
5,573,157 A * 11/1996 Mauriello et al. ..... 224/244

FOREIGN PATENT DOCUMENTS

WO 98/40686 * 9/1998 ..... 224/244

* cited by examiner

*Primary Examiner*—Stephen K. Cronin
(74) *Attorney, Agent, or Firm*—Charles C. Logan II

(57) ABSTRACT

The invention relates to a holster for handguns in which the handguns are held by the barrel or slide and the trigger guard, with a recess (9) being provided for the trigger guard of the gun, into which a retention pin (10), gripping the trigger guard from behind, can be pushed in or pulled out from the side, with a cheek (4) comprising magnets (5) for attaching the slide of the handgun being provided on the side of the recess (9). Preferably, for pushing in or pulling out the retention pin (10) a link-type guide (20) is provided at its end pointing away from the end engaging the recess (9) whereby if necessary, the retention pin (10) in its pushed-in position can be locked down.

9 Claims, 8 Drawing Sheets

Fig. 4
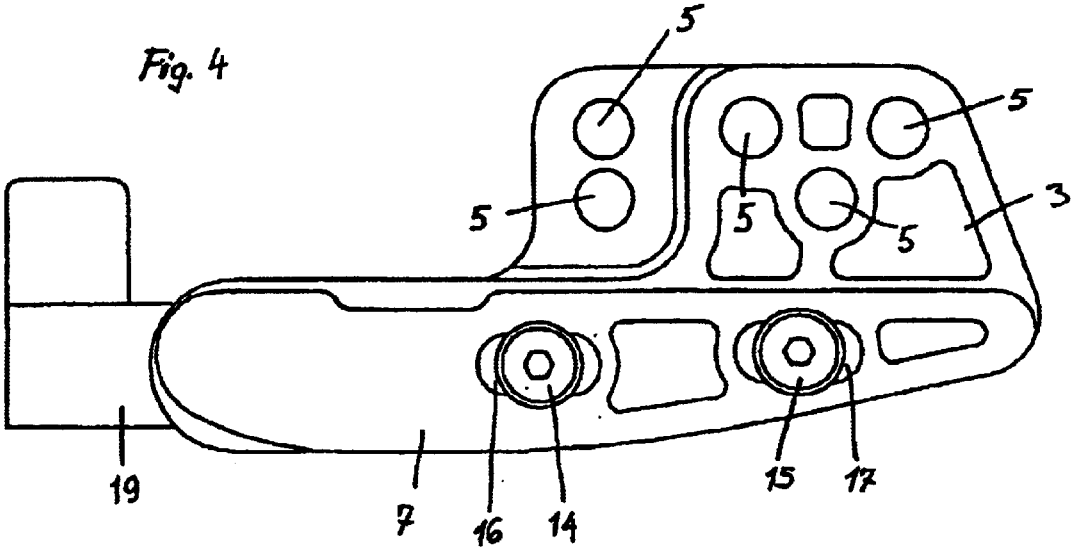
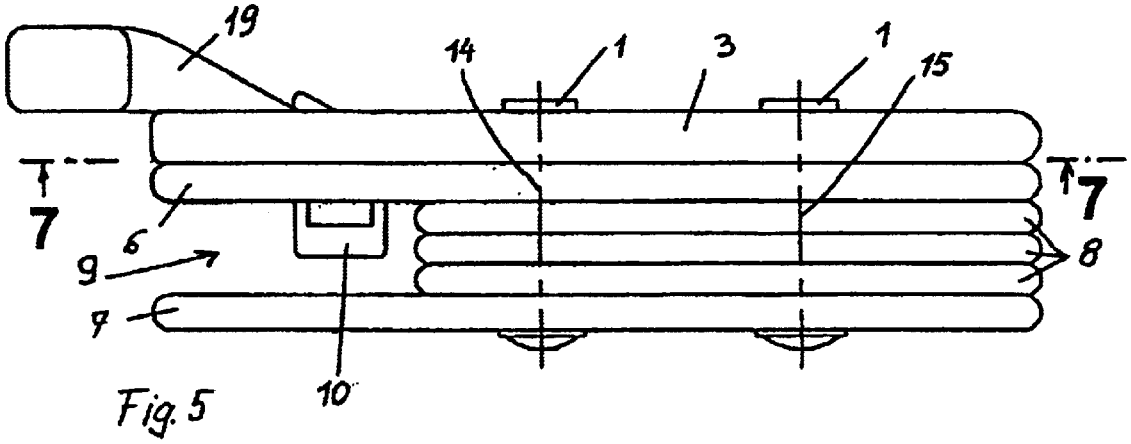
Fig. 5
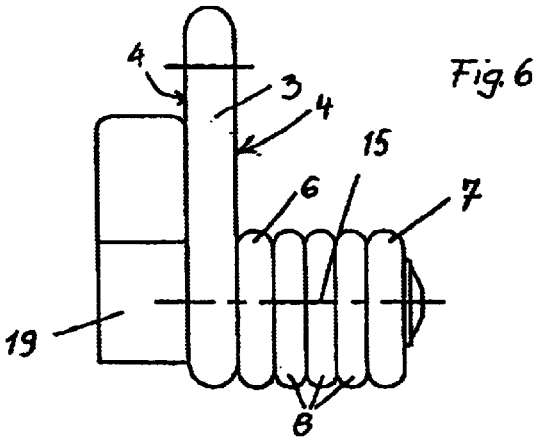
Fig. 6

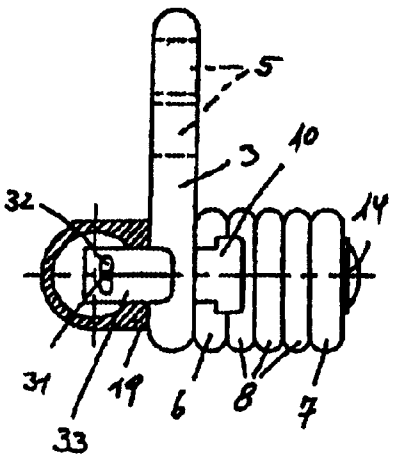
Fig. 13
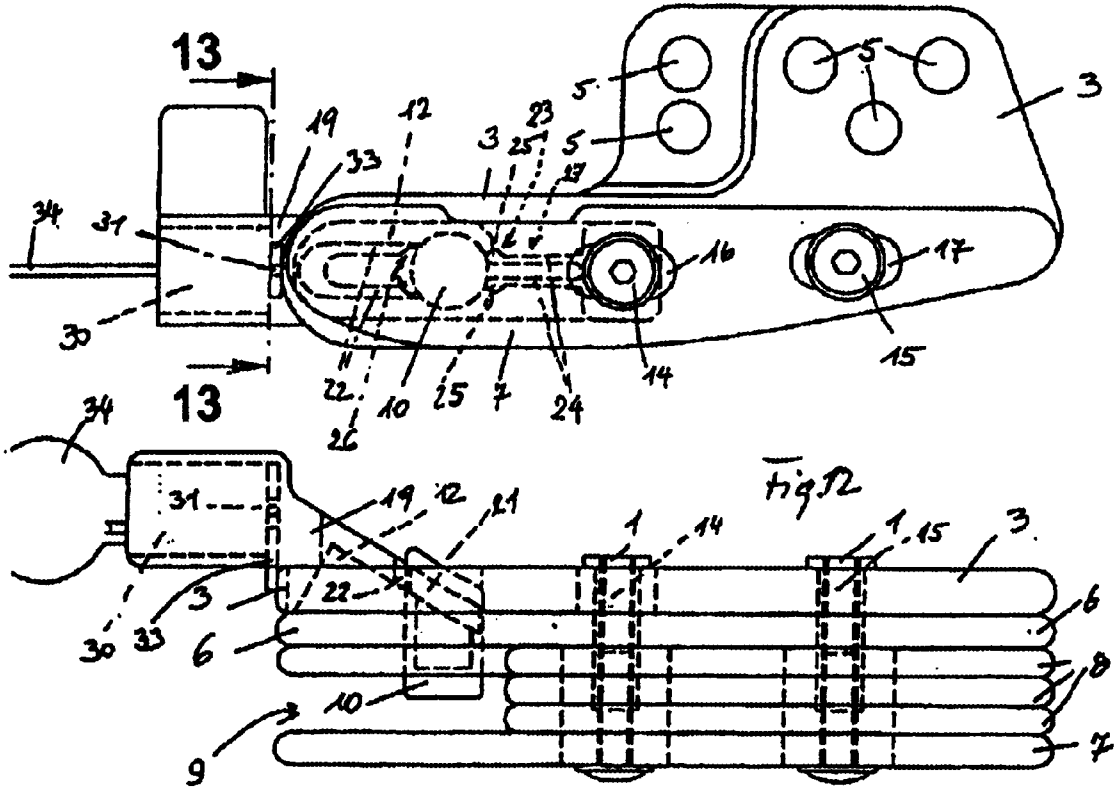
Fig. 11
Fig. 12

HOLSTER FOR HANDGUNS

BACKGROUND OF THE INVENTION

1. Field of the Invention

The invention relates to a holster for handguns in which the handguns are held by the barrel or slide and the trigger guard.

2. Description of Related Art

Commercially available holsters of this type comprise a u-profile-shaped base part which is provided for receiving the underside of the barrel, and on this receiving part there is then a lowered receiving part, also u-shaped, which is engaged by the trigger guard; for holding the gun in the holster, a clamping device for the trigger guard is provided in the receiving part for the trigger guard With this embodiment, the clamping force needs to be set rather low because otherwise the forces required to take the gun out from the holster would lead to long time delays which is important in particular during competitions. In order to prevent the gun from falling out of the holster with such low clamping forces, a rigid plastic shackle is provided over the receiving part receiving the barrel, with this receiving part encompassing the barrel or slide. Such designs have the disadvantage that the holsters are only applicable to very specific guns, and in addition, due to the securing clip encompassing the barrel, the placement of targeting devices or muzzle brakes is not possible.

BRIEF SUMMARY OF THE INVENTION

It is thus the object of the invention to create a holster of the type mentioned in the introduction which can be used universally and in which even guns with additional equipment such as targeting devices or muzzle brakes can quickly and safely be used.

According to the invention, this object is achieved in that a recess is provided for the trigger guard of the gun, into which a retention pin, gripping the trigger guard from behind, can be pushed in or pulled out from the side, with a cheek comprising magnets for attaching the slide of the gun being provided on the side of the recess. This insures that the retention pin provides safe retention of the gun in the holster. At the same time, the lateral cheek provided with magnets prevents any rotation of the gun around the retention pin. Since the holster supports the gun only on the bottom and on one side, it is possible to use the holster for various guns without any altercation, even if these guns are equipped with additional equipment such as targeting devices or muzzle brakes.

Preferably, the cheek comprising magnets is provided on a separate plate-shaped carrier which can be laterally attached to the base part comprising the recess. This has the advantage that the holster can be used both by left-handed or right-handed wearers, with only the cheek having to be fixed either to the left side or to the right side of the base part. In this, the base part itself is composed of at least three plate-shaped parts with the two exterior parts being longer than the middle part and exceeding the said middle part towards the handgun grip, thus forming the lateral cheeks for receiving the trigger guard. This provides, in a simple way, an easily adaptable base part by which the various distances between trigger guard and slide can be compensated for. Depending on the type of gun, it is only necessary to insert either a longer or shorter part in the middle. The individual components of the base part and the plate-shaped carrier for the lateral cheek can be fastened to each other by at least one screw bolt. This enables easy dismounting and adaptation of the individual components of the base part and the carrier. To provide an adaptable configuration with one and the same component of the base part, the receiving apertures for the screw bolts in the middle part and if necessary also in the exterior part pointing away from the carrier for the lateral cheek, can be configured as a slot or slots.

To ensure that the retention pin reliably grips the trigger guard of the gun from behind, the retention pin is spring loaded in the direction of pushing in. In this, the retention pin can be beveled towards the aperture of the recess. This facilitates insertion of the gun to the effect that the retention pin is pushed back by the trigger guard in the way of a spring-loaded catch and subsequently engages the catch behind the trigger guard. For easy pulling out of the retention pin from the recess, the retention pin at its end pointing away from the recess can comprise projecting parts distant across its longitudinal access, with the projecting parts being supported against the force of the spring by a fork-shaped piece which comprises wedge-shaped flanks, in which fork-shaped piece is moveable across the longitudinal axis on the retention pin. The retention pin is subsequently withdrawn from the aperture of the recess by sliding in the fork-shaped piece and sliding open the laterally distant projecting parts onto his wedge-shaped flanks, and when the fork-shaped piece is pulled back by the force of the spring, the retention pin is pushed in again. When inserting the gun into the holster, due to spring-loading, the retention pin can move freely without the fork-shaped piece having to be activated.

In a particularly simple way the fork-shaped piece can be guided in a recess in the plate-shaped carrier for the cheek comprising the magnets. The movable fork-shaped piece can also be used as a contact maker to insure that the retention pin has been entirely released in the sense of engaging the catch.

For controlled movement of the retention pin, for pushing in or pulling out the retention pin at its end pointing away from the end engaging the recess, a link-type guide can be provided. In this way, the movement of the retention pin is restrictably controlled, i.e. the pushing-in of the retention pin into the recess and thus the gripping from behind of the trigger guard must be actively undertaken. In this, when inserting the gun into the holster, the person carrying the gun notices whether or not retention of the gun by the retention pin takes place properly.

It is advantageous if, by the way of a link-type guide in the retention pin, at least one but preferably two notches are provided facing each other, whose cheeks aligned parallel to each other are aligned obliquely to the longitudinal axis of the retention pin, in the same direction; with these notches engaging obliquely aligned guide ways which point in the same direction, which guide ways are arranged at a slider adjustable transversely to the longitudinal axis of the retention pin. In this way, purely by moving the slider, control of engaging or disengaging the retention pin can be achieved in a simple way. Naturally, it would also be possible in kinematic reversal to provide the notch at the slider and the projecting part at the retention pin. To this purpose, the slider in the area comprising the guide ways can be fork-shaped with a detent for fixing the slider being provided between the tines of the fork. This insures that the retention pin engages properly because otherwise locking of the slider in the respective end position cannot occur.

For a particularly simple device, the detent can be formed by spring latches whose extremities comprise detent projections which click into recesses of the tines of a fork.

Finally, the spring latches can be arranged in a recess of that part of the holster which guides the slider and through which the retention pin passes. In this way proper mutual fixing can be achieved of the components effecting the fixing of the gun in the holster.

It has proven desirable to secure the gun in the holster in such a way that it cannot be removed from the holster by unauthorized persons. For this purpose, the retention pin gripping the trigger guard from behind, can be located down in its pushed-in position. This enables the owner of the gun to lock it down in the holster in such a way, that only after unlocking the retention pin is it possible to activate the means for withdrawing the retention pin. This also applies when the holster is worn on the body. This is to avoid the possibility of the gun being removed from the wearer by unauthorized persons, in a crowd or in similar situations.

Preferably a lock cylinder can be provided for locking down the retention pin; with the retention pin pushed in, the said lock cylinder locks down the said retention pin and/or its actuating mechanism. This makes for a very compact model which is simple to operate. On the lock cylinder, at the extremity facing the locking bolt, an actuating pin protruding away at the face can be eccentrically attached which interacts with a slot or similar, aligned transversely to the longitudinal axis of the locking bolt. It this way, by turning the lock cylinder, the locking bolt can be placed into a pushed-forward or a pulled back position by way of the retention pin, with the result that the retention pin is either locked or released.

In an embodiment in which the retention pin is forcibly moved to and fro by the activating organs, the lock cylinder can be provided in a slider comprising a link-type guide for pushing in or pulling out the retention pin, with the locking bolt resting against that part of the holster guiding the slider. In this way, the retention pin is fixed by way of the slider comprising the link-type guide.

With a different embodiment, the lock cylinder can be provided in the retention pin with the locking bolt being able to be pushed out of, or pulled into, the retention pin transversely to the longitudinal axis of the retention pin, and with the retention pin pushed in, rest against the interior side of the recess receiving the trigger guard of the gun. This makes for a very compact embodiment which does however have the disadvantage that due to little space being available, only a lock with few locking pins can be used.

Finally, the lock cylinder can form part of a shackle-type lock whose shackle, when the retention pin is pushed in, can be pushed and locked into a bore hole of the actuating slider which moves the retention pin by means of a link-type guide in the direction of its longitudinal axis. With this embodiment too, the retention pin is locked down by the actuating slider causing pushing in or pulling out of the retention pin, with this actuating slider also serving as a locking means.

BRIEF DESCRIPTION OF THE DRAWINGS

The drawings show embodiments of the subject of the invention.

FIG. 4 shows a second embodiment of the subject of he invention in lateral view, and FIG. 5 in top view.

FIG. 6 shows a front view

FIG. 11 shows a front view of a third version of an embodiment.

FIG. 12 shows the respective top view and

FIG. 13 a section along line XIII—XIII of FIG. 11.

DETAILED DESCRIPTION OF THE INVENTION

Figure 1:
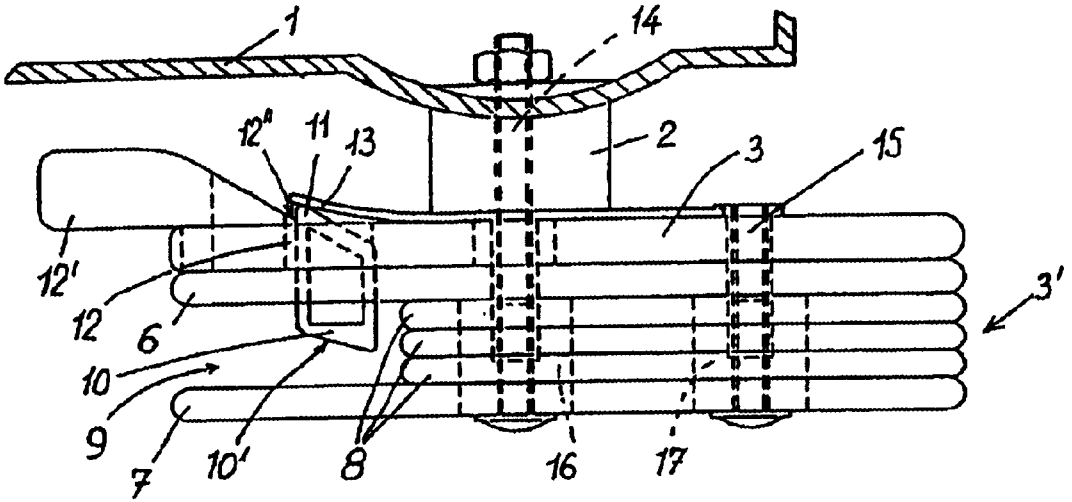
FIG. 1 is a top view of the holster, shown in the direction of the supporting surface of the base part.
Figure 2:
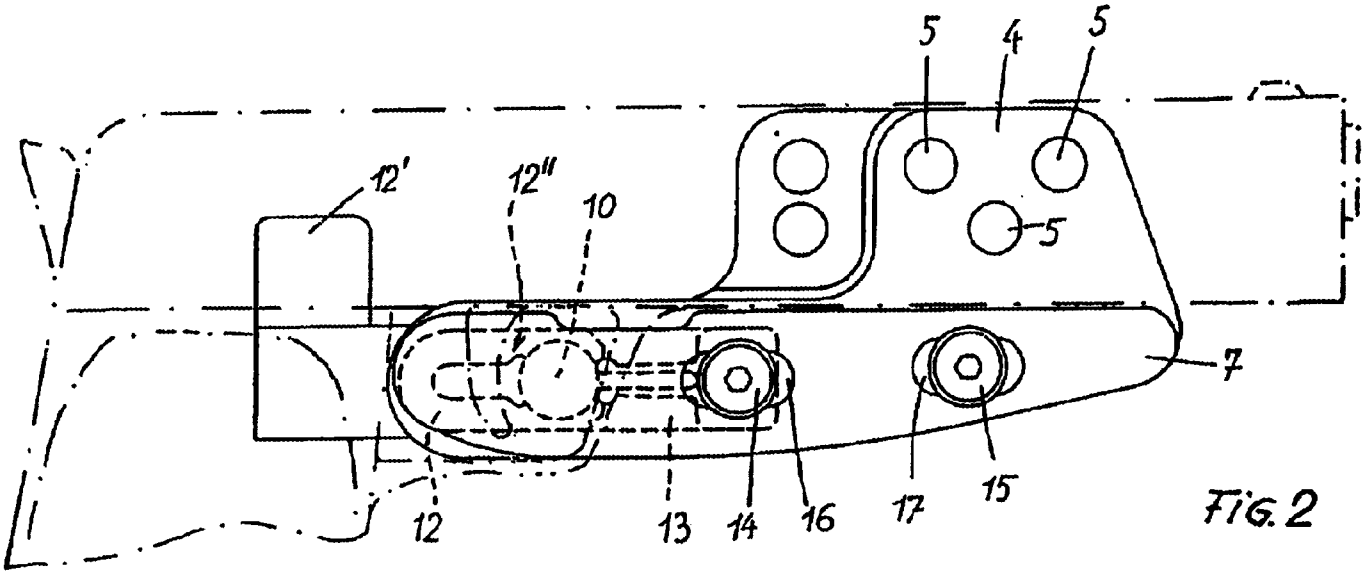
FIG. 2 is a front view with the gun indicated by a dot-dash line with the belt carrier not shown.
Figure 3:
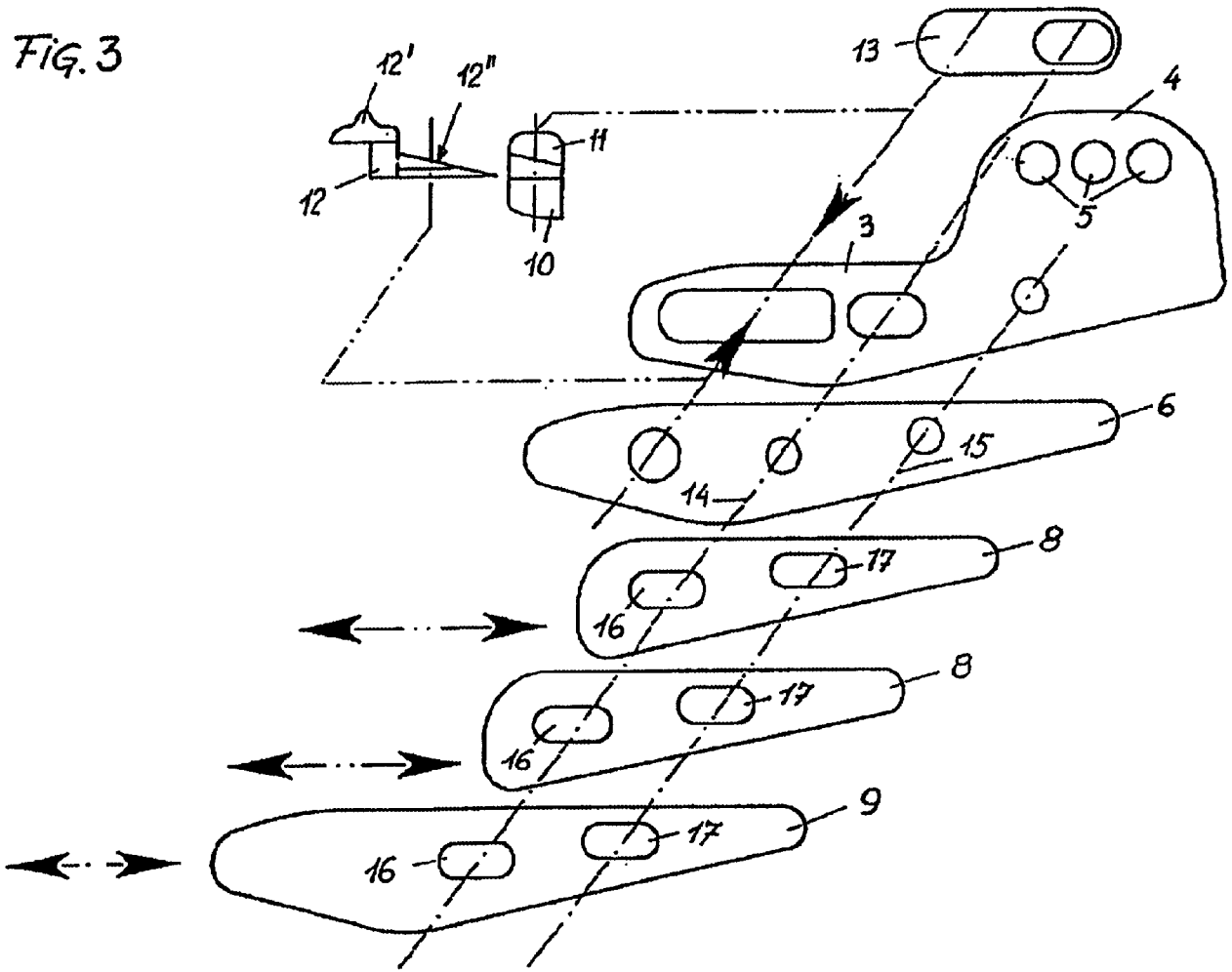
FIG. 3 is an exploded view of the individual components of the holster, without belt carrier and connecting pin.
Figure 7:
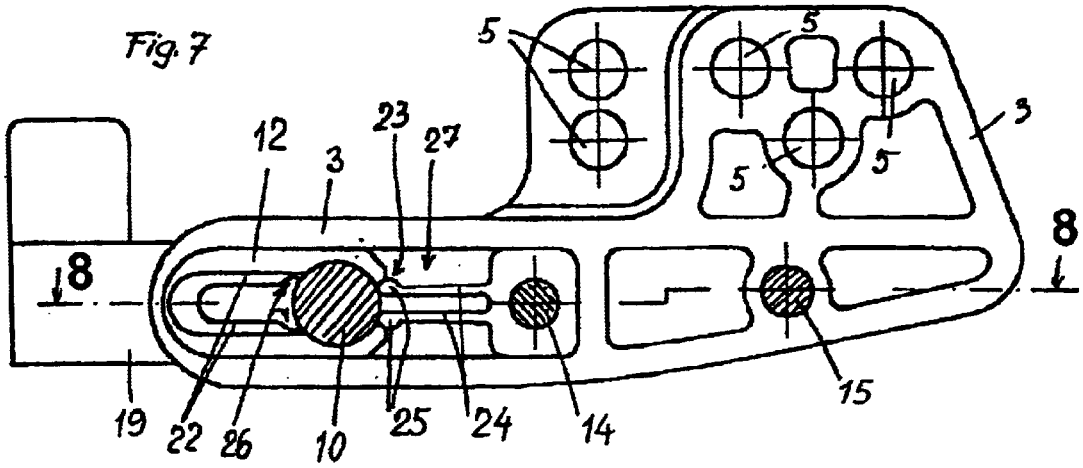
FIG. 7 illustrates a cut along line VII—VII of FIG. 5.

1 designates a partially cut away belt carrier to which a plate-shaped carrier 3 has been attached by way of a spacer 2. The said carrier 3 comprises a cheek 4 comprising magnets 5. A base part 3' is provided, resting flat against the carrier 3; the said base part 3' consists of several individual components which, in the version shown are formed by individual plate-shaped parts which are adjacent to the carrier 3, resting against each other on their flat side. The individual components of base part 3' comprise an inner exterior part 6 and an outer exterior part 7 between which three middle parts 8 are provided in the version shown. In the direction towards the handgun grip the two exterior parts 6 and 7 are longer than the middle parts 8, thus forming a recess 9 into which the grip shackle of the gun is to be inserted. A retention pin 10 protrudes into this recess; the end of this retention pin 10' pointing towards the open side of the recess 9 is beveled in such a way that the bevel point is sin the direction of the open side of the recess 9. On the other end, the retention pin 10 comprises a lug 11 which exceeds the retention pin 10 of both sides and which is guided in the carrier 3 of the cheek 4. The lug 11 which is protruding on both sides is gripped from behind by a fork-shaped 12, with the fork-shaped part 12 comprising wedge surfaces 12" into which the lug 11 of the retention pin 10 slides; see FIG. 3.

By means of a spring 13, the retention pin 10 is pre-loaded in the direction of the recess 9 via the lug of the retention pin 10. In this, the retention pin is guided in a bore holes in the carrier 3 and in the inner exterior part 6.

The individual plates are held together by screw bolts, 14,15, with holes for the passage of the screw bolts 14, 15 being formed in the shape of slots 16, 17, in the outer exterior part 7 and in the middle parts 8 of the base part 3'. In this way, the middle parts and the outer exterior parts of the base part 3' are kept moveable in a direction parallel to the direction of the barrel of the gun inserted. This makes it possible to adjust the distance between the retention pin 10 and the rear ends of the middle parts 8 of the base part 3' so as to fit the particular gun inserted at the time.

The transverse distance of the recess 9 can be predetermined by the number of the middle parts 8, or minor deviations can be attained by placing shims (not shown). The fork-shaped part 12 comprises a handgrip 12' which facilitates moving the fork-shaped part 12 and thus pulling in or pushing out retention pin 10 in the recess 9.

During use, the holster is fixed to the belt of the wearer by way of its belt carrier 1, by sliding it on a belt loop (not shown). The gun is then inserted into the holster in such a way that the slide made of metal and/or its upper part comes to rest against the magnets 5 and the trigger guard is positioned within recess 9 between the extensions of the exterior parts 6,7. When the gun is inserted into recess 9 with the fork-shaped part 12 pulled back, the retention pin 10, due to its bevel 10', can move back against the force of the spring 13, and after the trigger guard is positioned rests against the rear ends of the middle parts 8 of the base part 3', the fork-shaped part 12 can move forward again, as a result of the force of the spring 13. In this way, the front end of the retention pin 10 grips the trigger guard from behind and locks down the gun in the holster. To remove the gun, the fork-shaped part 12 is pushed forward by way of the handgrip 12'. In this way the lugs 11 slide along the wedge surfaces 12" of the fork-shaped part, thus pulling back the retention pin 10 from the recess 9. Now the gun is only held by magnets 5 and can thus easily be removed from the holster. In this, the retention pin 10 remains in the pulled-back position until the fork-shaped part 12 is pulled back by means of the handgrip 12' causing retention pin 10 to slide into recess 9. For may competitions, quick removal of the gun is desirable when the marksman is at the shooting range. In this case, the retention pin 10 can remain in the pulled-back position since the gun is held sufficiently well as a result of the magnets. By contrast, if the marksman or sports person needs to run, in between firing, or to overcome obstacles, then the retention pin is allowed to slide into the position where it protrudes into the recess 9, thus reliably preventing the gun from falling out. A trained marksman, when reaching to hold the gun, can at the same time move the fork-shaped part by way of the handgrip 12' forward in such a way that retention pin 10 is pulled out of its engagement position and thus releases the gun.

Figure 8:
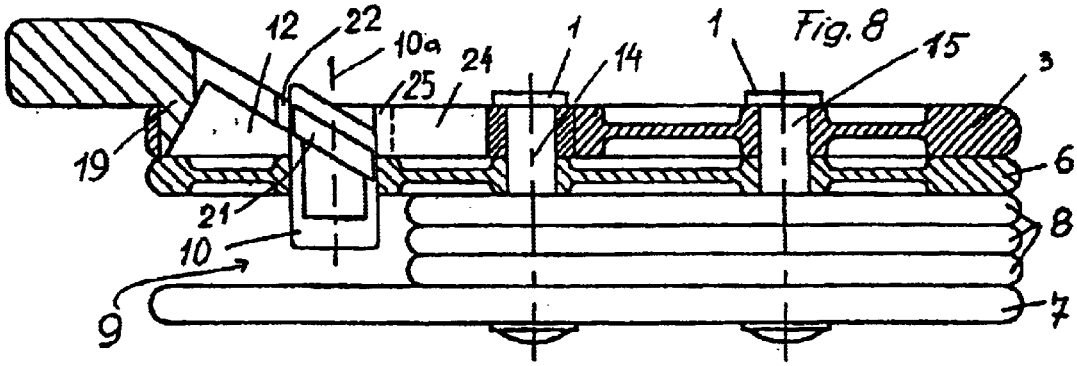
FIG. 8 shows a partial section along line VIII—VIII of FIG. 7.
Figure 9:
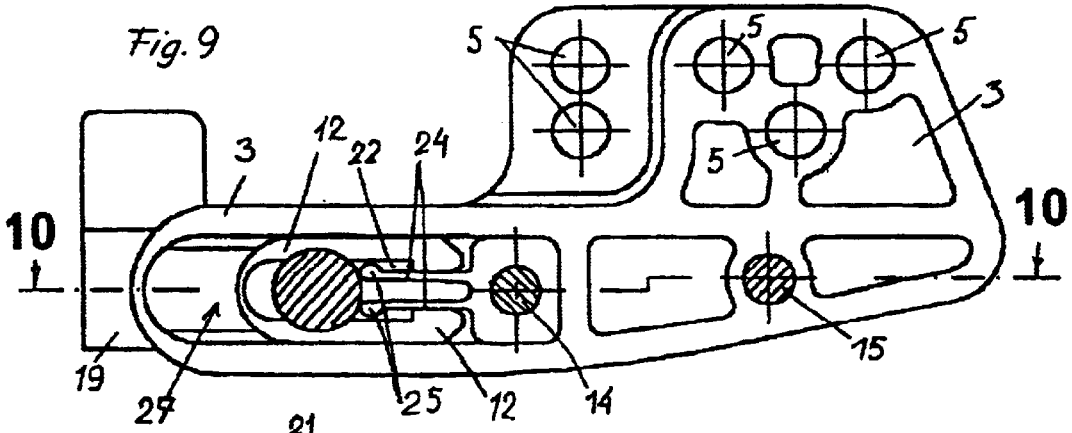
FIG. 9 is an illustration analogous to that in FIG. 7 but with the individual components in a different position in relation to the retention pin.
Figure 10:
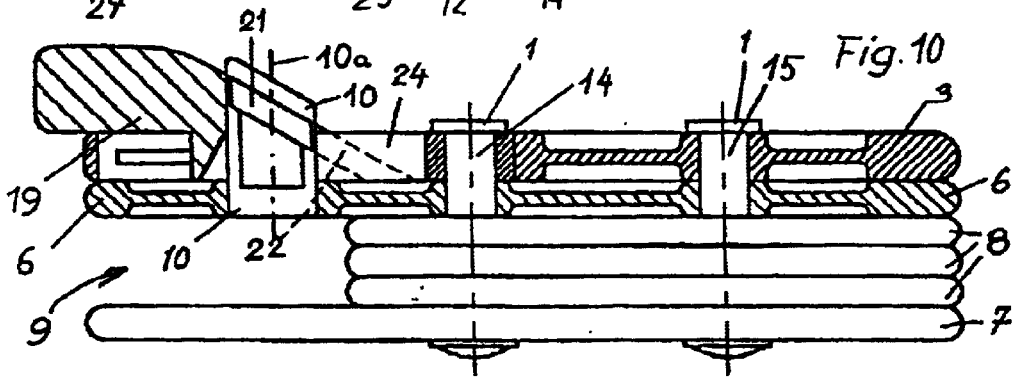
FIG. 10 shows a partial section along lines X—X of FIG. 9.

With the embodiment according to FIGS. 4 to 10, for moving the retention pin 10 into the recess 9 or out of it, a fork-shaped part on the slider 19 is provided with a link-type guide for moving the retention pin 10. The link-type guide is arranged by means of a notch 21 in the rear end of the retention pin 10 pointing away from the recess 9, and a guideway 22 provided at the fork-shaped part 12, with both being inclined towards the longitudinal axis 10*a* of the retention pin 10 in the same direction and in the same way. The inclination is such that when moving the slider 19 in the direction towards the front end of the holster, the retention pin 10 is pulled back from the recess 9, i.e. the inclination towards the rear end of the holster leads away from plate-shaped carrier 3. This can in particular be seen in FIGS. 8 and 10, with FIG. 8 showing the position of the individual components with the retention pin 10 pushed in and thus the slider 19 pulled back, and FIG. 10 with the retention pin 10 pulled back and thus the slider 19 is pushed forward.

In order to achieve locking of the individual components in their end positions, a detent 23 is provided which is formed by spring latches 24 provided with detent projections 25 which engage detent recesses 26 at the fork-shaped part 12. This detent is provided in a recess 27 in the plate-shaped carrier 3.

A further option provided by the holster according to the invention consists of the moveable fork-shaped part 12 or the hand grip 12' to be equipped with a signal device which preferably indicates acoustically the position of the fork-shaped lever 12; or which signal device can release an alarm if the fork-shaped part 12 is moved to an open position in an unauthorized way.

In this, the magnets 5 are incorporated into the cheek 4 of part 3 in such a way that they are exposed on both sides and thus can hold the gun on both sides. The carrier 3 of the cheek 4 is also configured in the same way so that the fork-shaped slider 12 and the retention pin 10 as well as the spring 13 can be inserted in a side-inverted way, so that the holster can easily be converted from a holster for right-handers to one for left-handers, or can be configured in such a way from the outset.

In this way, the holster according to the invention is on the one hand universally useable and on the other hand particularly suitable for sporting shooters and also for executives because in addition to secure retention it also offers the option of providing signal devices indicating unauthorized activation of the retention pin 10.

With the embodiment according to FIGS. 11–13 for locking down the slider 19 by way of which the retention pin can be moved into its respective position (pushed in or pulled back), the retention pin is provided with a lock cylinder 30 at the bottom of which an actuating pin 31 is eccentrically arranged which interacts with a slot 32 of a locking bolt 33. The lock cylinder can be rotated around its axis using a key 34. By turning the lock cylinder 30, the actuating pin 31 can be moved in an arc of 180 degrees. In this way the locking bolt 33 is either pulled back into the slider 19 thus enabling a movement of the slider 19 to relocate the retention pin 10; or else, if the slider 19 is pulled back, the locking bolt 33 is moved out of it so that the locking bolt 33 protrudes from the slider 19 in such a way that it rests on the carrier 3 against the surface facing it. In this way, the slider 19 is prevented from moving, and the retention pin 10 is fixed in its pushed-in position (see FIG. 12). To release the retention pin 10, the lock cylinder 30' is rotated in such a way by means of the key 30 that the locking bolt 33 is moved into its pulled-back position inside the slider 19.

Figure 14:
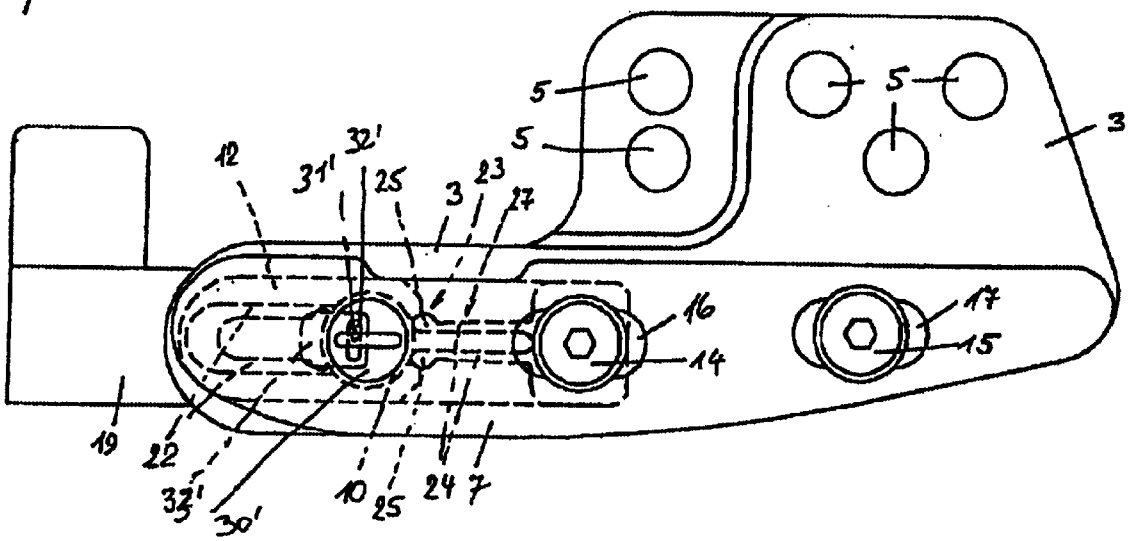
FIG. 14 represents a front view of a fourth embodiment.
Figure 15:
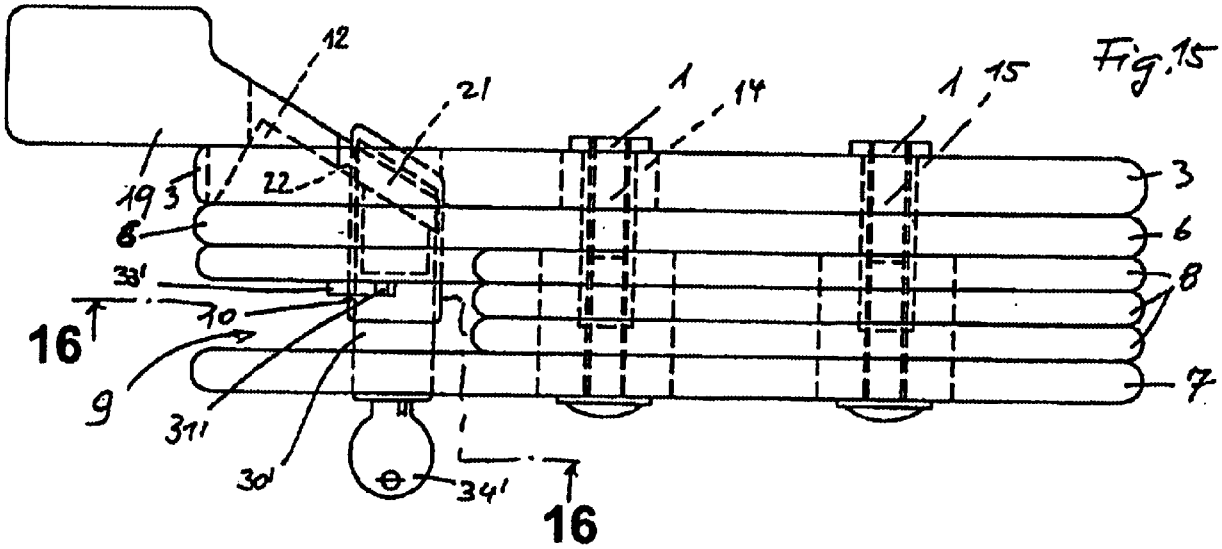
FIG. 15 is a top view of this embodiment.
Figure 16:
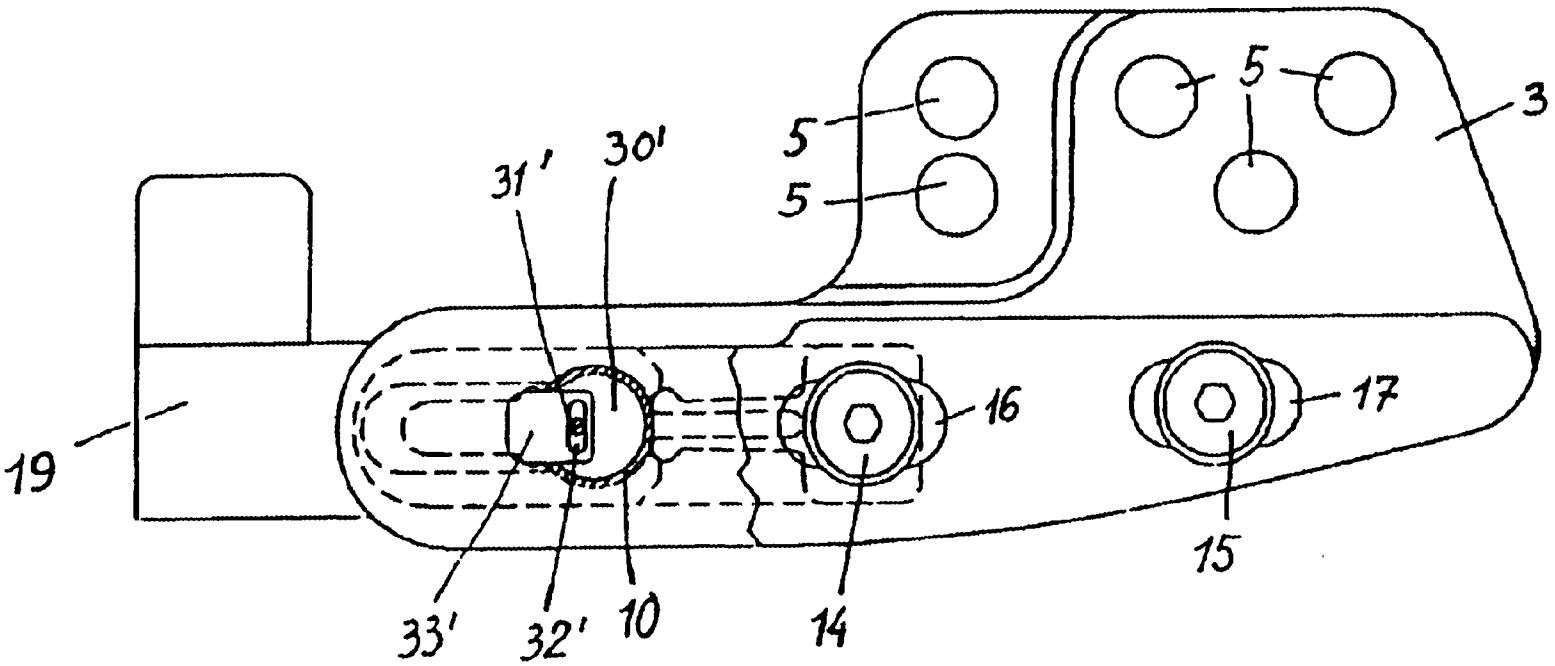
FIG. 16 shows a partial section along line XVI—XVI of FIG. 15.

In the embodiment according to FIGS. 14–16, the locking cylinder 30' is directly arranged in the retention pin 10, in such a way that it can be inserted into the retention pin 10 or removed from it. At the bottom of the locking cylinder 30' there is also an actuating pin 31' eccentrically attached which engages a slot 32' of a locking bolt 33' which by turning the locking cylinder can either be completely pulled back into this locking cylinder or through an aperture in the retention pin 10 moved out of the latter until the locking bolt rests against the flank of the recess 9 facing it, for receiving the trigger guard; thus preventing pulling back of retention pin 10. The lock cylinder can be freely inserted in to the retention pin as soon as the locking bolt 33' has been entirely pulled back behind the locking cylinder. Guide ribs (not shown) are provided for guiding the lock cylinder in the correct position when it is inserted into the retention pin, and to allow moving forward of the locking bolt 33' after the key 34' is turned. In this case too, repositioning is by turning the key 180 degrees, so that as a result of the eccentricity of the actuating pin 31', the pushing-out or pulling-back movement of the locking bolt 33' is achieved.

Figure 18:
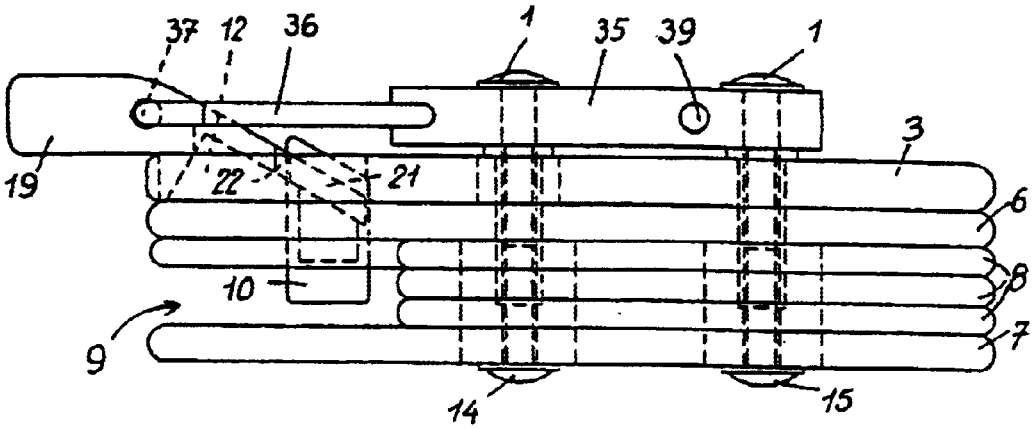
FIG. 18 is a view from below of the embodiment according to FIG. 17.
Figure 17:
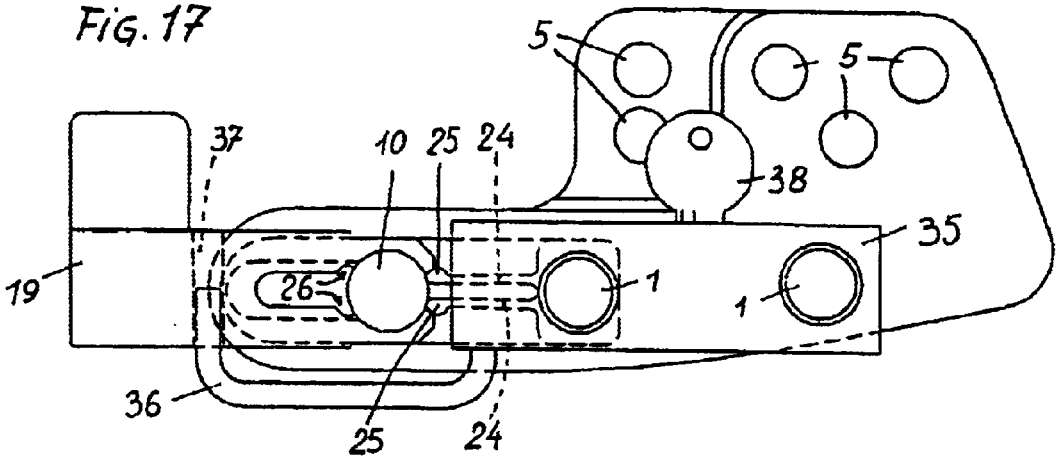
FIG. 17 shows a front view of a fifth embodiment.
Figure 19:
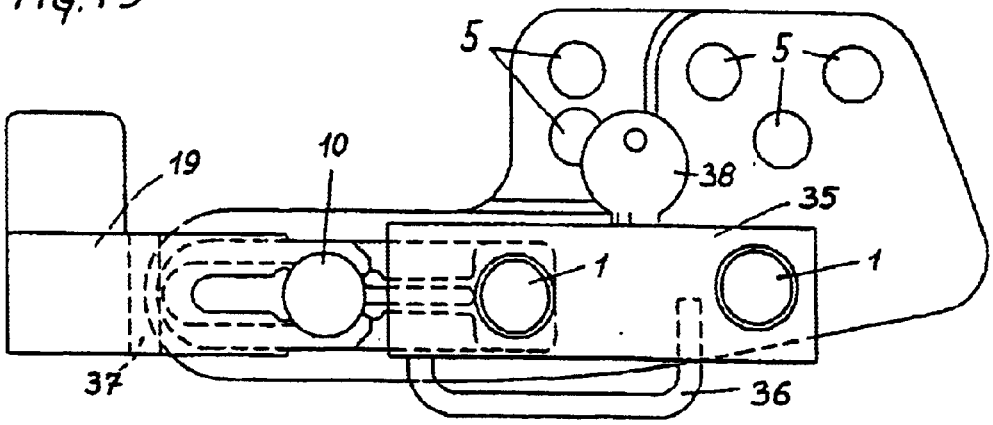
FIG. 19 shows the embodiment according to FIG. 17 in an unlocked position.

In the last embodiment shown, according to FIGS. 17–19, the lock cylinder is provided as part of a shackle-type lock 35 which is provided with a shackle 36 which can be moved out of the lock and into the lock in the manner of a padlock.

In the present case, this shackle-type lock 35 can also be locked in such a way that the shackle in its position swiveled outward by 180 degrees (See FIG. 17), can be locked, to such effect that the shackle in its swivelled-out position, when pushed into the lock, can be locked by the lock cylinder. To lock down the slider 19, a bore hole 37 is provided whose longitudinal axis in the swivelled-out position coincides with the longitudinal axis of the leg of the shackle. To lock it, shackle 36 is swivelled into the position shown in FIG. 17 and inserted into the bore hole 37 of slider 19 which must be in the pulled back position in which the retention pin is pushed forward into the recess 9. A key 38 is provided to actuate the lock cylinder.

For the home position as shown in FIG. 19, the lock comprises a bore hole 39 (see FIG. 18) into which the free end of shackle 36 can be lowered which releases in the position releasing the slider 19 for axial movement. In this position the slider 19 is free and can be repositioned accordingly for repositioning the retention pin 10 according to the above description.

What is claimed is:

1. A holster for handguns having a barrel and a trigger guard in which the handguns are held by the barrel and the trigger guard comprising:

at least one elongated vertically oriented middle plate having a front end rear end, a left side, a right side, a top surface and a first length;

an elongated vertically oriented inner exterior plate having a front end, a rear end, a left side, a right side, a top surface and a second length; said second length being greater than said first length;

an elongated vertically oriented outer exterior plate having a front end, a rear end, a left side, a right side, a top surface and a third length; said third length being greater than said first length;

said right side of said inner exterior plate being positioned adjacent said left side of said middle plate; said left side of said outer exterior plate being positioned adjacent said right side of said middle plate; said rear end of said inner exterior plate and said outer exterior plate extending rearwardly from said rear end of said middle plate to form a recess into which a trigger guard of a handgun can be removably inserted; said top surfaces of said inner exterior plate, said middle plate and said outer exterior plate being oriented substantially at the same height so that a gun barrel of a handgun can rest upon said respective top surfaces and be supported thereon;

means for releasably securing said inner exterior plate, said middle plate and said outer exterior plate together;

an elongated retention pin having an inner end, an outer end, surrounding side walls extending from said inner end to said outer end and a longitudinally extending axis;

a retention pin aperture extending transversely through said inner exterior plate at a position where said retention pin aperture communicates with said recess for receiving a trigger guard; and means for supporting said retention pin and reciprocally moving said retention pin into said recess for capturing a trigger guard of a handgun therein and preventing removal therefrom.

2. A holster for handguns as recited in claim 1 wherein there are a plurality of middle plates with the number of middle plates determined by the width of a gun barrel of a handgun to be supported by said middle plates.

3. A holster for handguns as recited in claim 1 further comprising means for locking said retention pin inside a trigger guard of a handgun.

4. A holster for handguns as recited in claim 1 further comprising means for attaching said holster to a belt of a person carrying a handgun.

5. A holster for handguns as recited in claim 1 further comprising means for producing an audible click sound when said retention pin completes its travel into said recess and also when said retention pin is completely removed from said recess.

6. A holster for handguns as recited in claim 1 further comprising means for adjusting the length of said recess to accommodate handguns having different sized trigger guards.

7. A holster for handguns as recited in claim 1 further comprising an elongated plate-shaped carrier having a front end, a rear end, a left side, a right side, a top surface and a fourth length; said fourth length being greater than said first length; a plate-shaped cheek portion extends upwardly from said top surface and functions to prevent lateral travel of a gun barrel of a handgun; said right side of said plate-shaped carrier being positioned against said left side of said inner exterior plate.

8. A holster for handguns as recited in claim 7 further comprising at least one magnet mounted in said cheek portion to magnetically capture a gun barrel of a handgun.

9. A holster for handguns as recited in claim 7 further comprising a slider member connected to said plate-shaped carrier; said slider member being connected to said retention pin.

* * * * *